US005713105A

United States Patent [19]

Toomey

[11] Patent Number: 5,713,105

[45] Date of Patent: Feb. 3, 1998

[54] ADJUSTABLE HINGE

[75] Inventor: Mark H. Toomey, Moline, Ill.

[73] Assignee: Lawrence Brothers Inc., Sterling, Ill.

[21] Appl. No.: 717,270

[22] Filed: Sep. 20, 1996

[51] Int. Cl.[6] ..... E05D 7/04

[52] U.S. Cl. ..... 16/245; 16/238

[58] Field of Search ..... 16/243, 245–248, 16/235–238, 382, 387, DIG. 43, DIG. 39

[56] References Cited

U.S. PATENT DOCUMENTS

| | | | |
|---|---|---|---|
| 375,038 | 12/1887 | Wright | 1/246 |
| 982,160 | 1/1911 | Regan . | |
| 1,125,177 | 1/1915 | Rixson . | |
| 2,302,484 | 11/1942 | Werner . | |
| 2,373,955 | 4/1945 | Fuller | 16/238 |
| 2,657,421 | 11/1953 | Polson . | |
| 3,007,193 | 11/1961 | Hughes et al. . | |
| 3,805,324 | 4/1974 | Johnson . | |
| 3,965,532 | 6/1976 | Wigfall | 16/270 |
| 4,159,557 | 7/1979 | Pittasch et al. . | |
| 4,493,129 | 1/1985 | Grass . | |
| 4,748,717 | 6/1988 | Osborne . | |
| 4,825,507 | 5/1989 | Killingstad . | |
| 5,052,077 | 10/1991 | Lautenschlager et al. | 16/238 |
| 5,339,493 | 8/1994 | MacIntyre . | |

FOREIGN PATENT DOCUMENTS

| | | | |
|---|---|---|---|
| 3-39581 | 2/1991 | Japan | 16/243 |
| 2032994 | 5/1980 | United Kingdom | 16/237 |

*Primary Examiner*—Chuck Mah

*Attorney, Agent, or Firm*—Trexler, Bushnell, Giangiorgi & Blackstone, Ltd.

[57] ABSTRACT

A vertically adjustable hinge which permits easy, small and precise vertical adjustments. The hinge includes a body, a first leaf and a second leaf. It should be noted that the hinge may be provided only as a body and a first leaf for retrofitting on to an existing second leaf. The body includes a leaf cavity, an adjustment mechanism cavity and, where necessary, a window. The window extends from a face side of the body and communicates with the adjustment mechanism cavity. The adjustment mechanism cavity communicates with the leaf cavity. The leaf cavity is sized and dimensioned to receive a planer portion of the first leaf therein with additional space for vertical adjustment of the first leaf. An adjustment mechanism is provided in the form of an elongated jack screw having a head which engages a slot formed in the first leaf and a threaded portion which engages a fixed thread. In another embodiment the adjustment mechanism is arranged with the head engaged with the body and the fixed thread disposed relative to the first leaf. In both embodiments, the adjustment mechanism is disposed in the adjustment mechanism cavity. A drive portion is provided on the adjustment mechanism of both embodiments to allow rotary movement of the adjustment mechanism to produce vertical displacement thereof.

25 Claims, 3 Drawing Sheets

ADJUSTABLE HINGE

BACKGROUND

The present invention relates to adjustable hinges which permit the vertical adjustment of a center leaf relative to a frame leaf.

A variety of adjustable hinges are available which provide vertical adjustment of a center leaf relative to a frame leaf. The prior art hinges include a body, a center leaf mounted in the body and a frame leaf attached to the center leaf by way of a hinge pin. The prior an adjustable hinges typically employ quite complex adjustment mechanisms. The adjustments are difficult and require much effort.

Other prior art adjustable hinges have adjustment mechanisms which can be accessed by power tools. Use of power tools to adjust this type of hinge may create a problem in that the tradesman installing and adjusting such an adjustable hinge may inaccurately adjust the hinge as a result of using power tools. Inaccurate adjustment may result in damage to the hinge, which in turn thereby increasing the overall cost of the installation employing the hinge as a result of increased equipment costs (i.e. replacement hinges) as well as installation labor time. Additionally, the ability to use power tools with an adjustable hinge may create a problem in that the adjustments may be too dramatic and not in small enough increments.

Another problem that arises with prior art hinges is that they are difficult to manufacture as a result of having numerous moving parts which may be disposed at angles relative to the center leaf. These numerous moving pans require operation of multiple mechanisms in order to achieve vertical adjustment. Such prior an hinges require additional education and training in order to provide proper use of the hinge. Without the additional education and training to properly use the hinge, the hinge is often misused, improperly installed or improperly adjusted. The complexities of prior art hinges often result in misuse of the hinge, thereby defeating the additional expense invested in the adjustable mechanism.

For the foregoing reasons, there is a need for an improved and simplified adjustable hinge which permits controlled, positive vertical positioning of the center leaf of the hinge.

OBJECTS AND SUMMARY

An object of the claimed invention is to provide an improved adjustable hinge which allows for vertical adjustment of one of the leafs of the hinge.

Another object of the present invention is to provide a simplified vertically adjustable hinge.

Still a further object of the claimed invention is to provide a vertically adjustable hinge which prevents the use of power tools to make vertical adjustments to the hinge.

Still another object of the claimed invention is to provide a vertically adjustable hinge which intentionally restricts the movement of an adjustment mechanism so as to provide small and precise incremental adjustments of the hinge.

Briefly, and in accordance with the foregoing, the present invention envisions a vertically adjustable hinge which permits easy, small and precise vertical adjustments. The hinge includes a body, a first leaf and a second leaf. It should be noted that the hinge may be provided only as a body and a first leaf for retro-fitting on to an existing second leaf. The body includes a leaf cavity, an adjustment mechanism cavity and, where necessary, a window. The window extends from a face side of the body and communicates with the adjustment mechanism cavity. The adjustment mechanism cavity communicates with the leaf cavity. The leaf cavity is sized and dimensioned to receive a planer portion of the first leaf therein with additional space for vertical adjustment of the first leaf. An adjustment mechanism is provided in the form of an elongated jack screw having a head which engages a slot formed in the first leaf and a threaded portion which engages a fixed thread. In another embodiment the adjustment mechanism is arranged with the head engaged with the body and the fixed thread disposed relative to the first leaf. In both embodiments, the adjustment mechanism is disposed in the adjustment mechanism cavity. A drive portion is provided on the adjustment mechanism of both embodiments to allow rotary movement of the adjustment mechanism to produce vertical displacement thereof.

BRIEF DESCRIPTION OF THE DRAWINGS

The organization and manner of the structure and function of the invention, together with further objects and advantages thereof; may be understood by reference to the following description taken in connection with the accompanying drawings, wherein like reference numerals identify like elements, and in which.

DESCRIPTION

Figure 1:
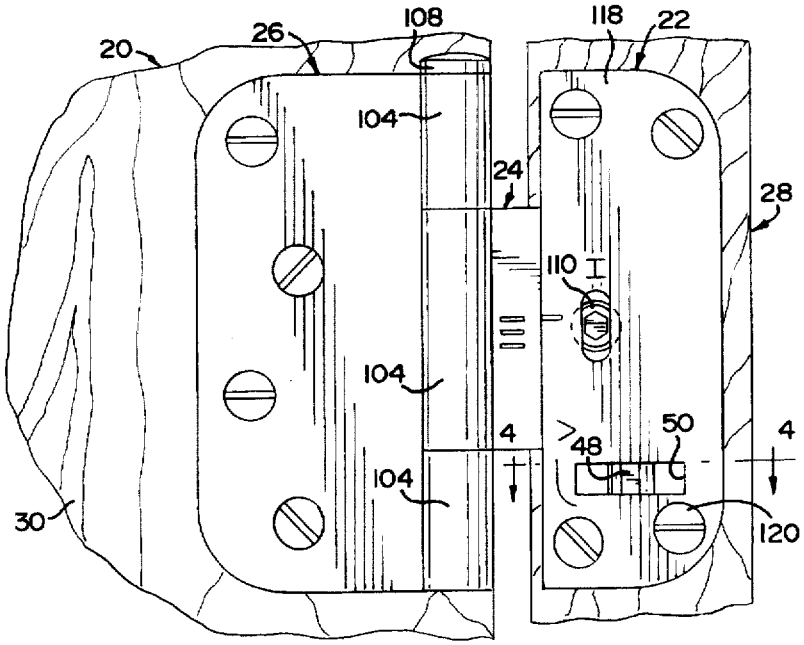
FIG. 1 is a partial fragmentary, elevational view of a vertically adjustable hinge having a body shown mounted to a door, a first leaf retained in the body and a second leaf engaged with the first leaf and mounted to a frame.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

FIG. 1 shows a novel vertically adjustable hinge 20 of the present invention. The hinge includes a body 22, a first leaf 24 engaged with the body 22 and a second leaf 26. The body 22 is attached to a first structure 28 shown in FIG. 1 as a door 28, and the second leaf 26 is attached to a second structure 30, shown in FIG. 1 as a door frame 30. Additionally, the first leaf 24 is shown in FIG. 1 as being a center leaf 24 and the second leaf 26 is shown as a frame leaf 26. It should be understood that the adjustable first leaf 24 need not be limited to the center leaf. Based on the teachings as set forth herein, one of skill in the art could devise the adjustable hinge of the present invention for use with a frame leaf as well.

Figure 2:
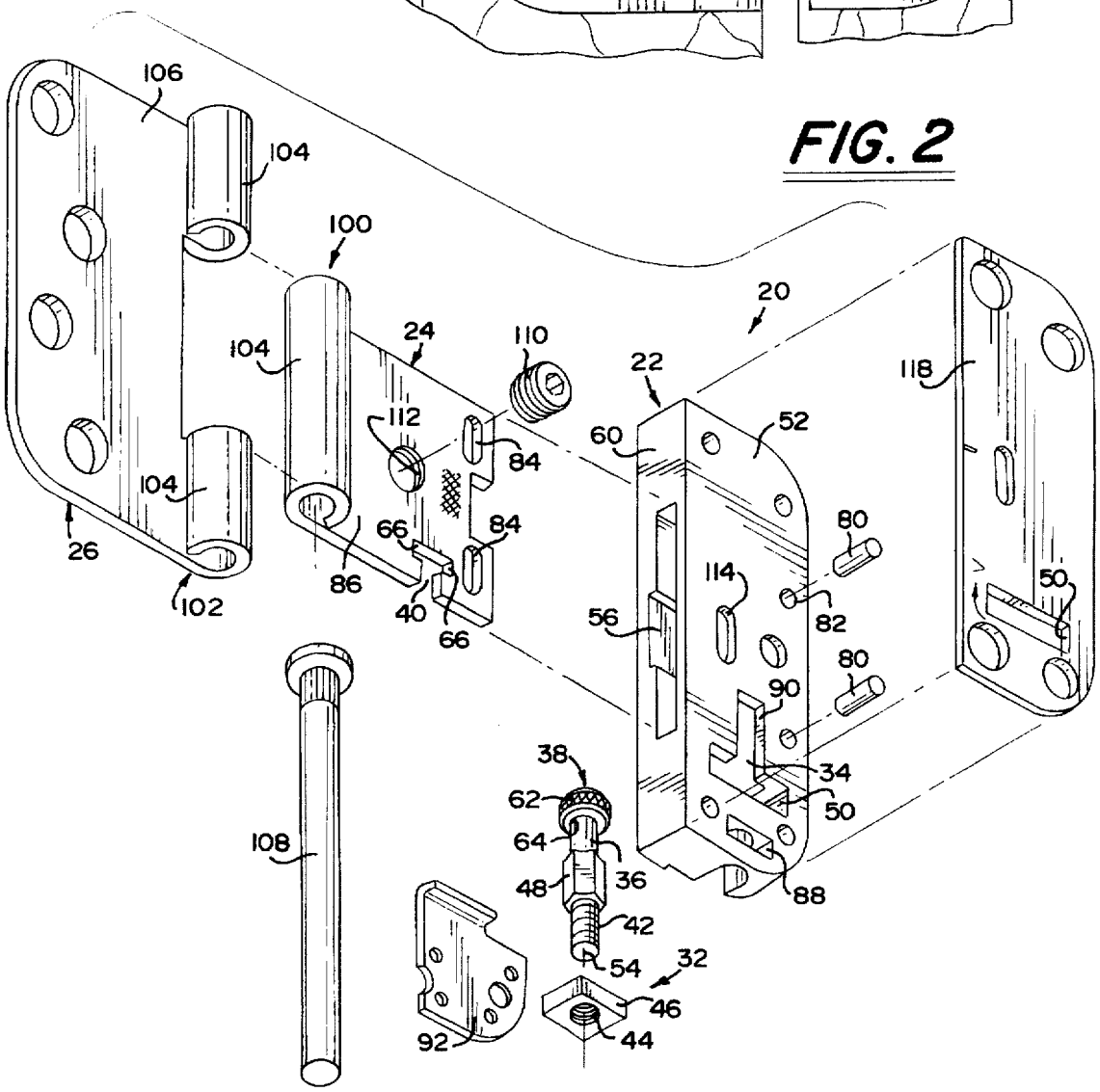
FIG. 2 is an exploded perspective view of the vertically adjustable hinge as shown in FIG. 1 showing the component parts disengaged therefrom, several component mounting screws have been omitted in the interest of clarity.
Figure 3:
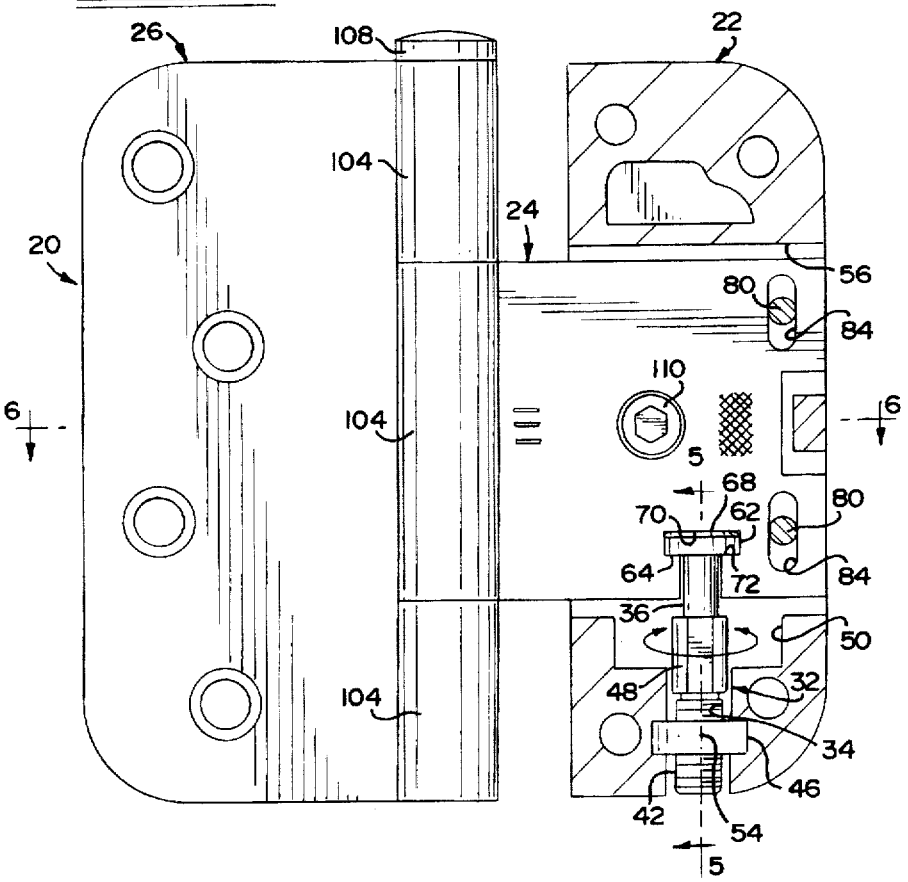
FIG. 3 is a partial fragmentary, cross-sectional, plan view of the vertically adjustable hinge as shown in FIG. 1 further showing the internal structure of the body, in particular an adjustment mechanism engaged with the first leaf and retained within the body.
Figure 4:
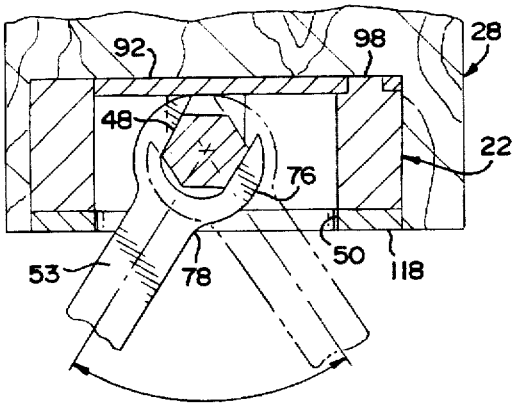
FIG. 4 is a partial fragmentary, cross-sectional, plan view taken along line 4—4 in FIG. 1 showing the operation of the adjustment mechanism by a tool and further showing the limited degree of movement of the adjustment mechanism in order to provide small, precise incremental adjustments of the hinge.

With reference to FIGS. 2–6, the present invention includes an adjustment mechanism 32 which is retained within an adjustment mechanism cavity 34 formed in the body 22. The adjustment mechanism 32 as illustrated is an axially elongated, threaded jack screw which includes an axially elongated shaft 36 having a first end 38 engaged with a slot 40 in the first leaf 24 and has a threaded portion 42. The adjustment mechanism 32, and more particularly the threaded portion 42, engages a fixed corresponding thread 44. As shown in FIGS. 2–4, the fixed corresponding thread 44 is formed in a nut 46. The nut 46 is also retained in the adjustment mechanism cavity 34. Additionally, it should be appreciated based on the teaching herein that the fixed corresponding thread 44 may also be formed by tapping the necessary threads in the body 22. A drive portion 48 is provided on the shaft 36 and positioned in the adjustment mechanism cavity 34 (see FIGS. 3–5) so that it is accessible through a window 50 formed in a face side 52 of the body 22.

Having briefly described the general elements of the illustrated embodiment of the present invention, it can be seen with reference to FIGS. 1–5, that the drive portion 48 is accessible through the window 50. A tool 53 is inserted through the window 50 to engage the drive portion 48 thereby allowing a tradesperson to rotate the adjustment mechanism 32 about a central axis 54. Rotation of the adjustment mechanism 32, having the threaded portion 42 engaged with the nut 46 results in vertical motion of the adjustment mechanism 32 along the axis 54. Because the first end 38 is engaged in the slot 40 of the first leaf 24, the first leaf 24 is urged upwardly or downwardly within a leaf cavity 56 in the body 22.

At this point, it should be noted that the foregoing description and substantial portions of the following description will discuss the hinge 20 as shown in FIGS. 1–6. The present invention also relates to the portion of the entire hinge 20 including the body 22, the components directly attached thereto or retained therein, and the first leaf 24. As such, the body 22 and first leaf 24 could be provided as a retrofit assembly for attachment to an existing second leaf 26. Therefore, the scope of the claims of the present invention should not be limited to requiting a second leaf 26.

Having now briefly reviewed the overall structure and function of the present invention, we will provide a more detailed description of the components of this invention. The body 22 is an integrally formed structure providing apertures, accesses, windows and cavities as described herein. The leaf cavity 56 is formed in the body 22 generally parallel with the face side 52 and a concealed side 58 (see FIG. 5) opposite the face side 52. The adjustment mechanism cavity 34 is formed through the concealed side 58. The leaf cavity 56 extends through an edge 60 of the body 22. The adjustment mechanism cavity 34 and the leaf cavity 56 are in communication. The window 50 is positioned between the leaf cavity 56 and the adjustment mechanism cavity 34 communicating with both cavities 56, 34. FIG. 3 provides a clear illustration of the relationship of the cavities 34, 56 and the window 50.

As shown in FIGS. 2, 3 and 4, the adjustment mechanism 32 has a head 62 defining a radially extending portion 64. The slot 40 is a T-shaped slot having oppositely extending cross extension areas 66. The radially extending portion 64 of the head 62 is positioned to engage the cross extension areas 66 and provide engagement of the head 62 in the slot 40. The head 62 and slot 40 configuration as shown herein is a preferred embodiment because the engagement of the portions and extensions 64, 66 promote vertical movement of the first leaf 24 both upwardly and downwardly. When moving the first leaf 24 upwardly a top surface 68 of the head 62 drives against an inside edge 70 of the T-slot 40. When moving the first leaf 24 downwardly, the radially extending portion 64 of the head abut and drive against ledges 72 of the cross extensions 66.

Positive vertical positioning of the first leaf 24 is provided by the adjustment mechanism 32 engaged with the first leaf 24 retained in the body 22, and having the threaded portion 42 engaged with the thread 44 of the nut 46. Movement of the adjustment mechanism 32 is limited by the structure of the adjustment mechanism 32 and the configuration of the window 50. As described in the Background section, it is undesirable to employ power tools to make small, accurate and precise adjustments such as required in the adjustment of a hinge. As such, the present invention configures the adjustment mechanism 32 and the threads 42, 44 as well as the window 50 to require small incremental rotations of the adjustment mechanism 32. With reference to FIG. 4, the drive portion 48 is configured for engagement with a corresponding tool 53. As specifically shown in FIG. 4, a wrench 53 engages a standard sized hex body comprising the drive portion 48. The head 76 of the wrench engages the drive portion 48. The relative position of the arm 78 of the wrench 24 within the boundaries of the window 50 limits the range of angular motion of the wrench 53 to generally 90–120 degrees. As a result, the combination of the thread pitch and positioning of the wrench having to be performed through the window 50 permits only small incremental rotations. For example, in a preferred embodiment, approximately 40 wrench engagements and rotations are required to make a vertical adjustment of approximately ¼".

It is envisioned that other forms of drive portions and tool combinations may be employed within the scope of the present invention. In particular, the drive portion 48 can be configured with holes or apertures for engagement by a rod or hex wrench. Engagement of the rod or hex wrench with the holes will allow rotation of the adjustment mechanism along the central axis 54. Similarly, it is envisioned that the drive 48 portion can be embodied as a series of axially aligned radially extending slots which are engageable by the blade of a standard tip screwdriver. In these embodiments, as well as the preferred embodiment as shown in the drawings, small incremental rotations are made thereby limiting the rate of vertical movement of the first leaf 24.

The body 22 has been configured to facilitate ease of assembly of the present invention. More particularly, the body 22 as described above is formed as an integral component. During assembly, the first leaf 24 is inserted into the leaf cavity 56 and horizontal restraint pins 80 are inserted through corresponding bores 82 extending through elongated apertures 84 in a planer portion 86 of the first leaf 24. The horizontal restraint pins 80 prevent removal of the first leaf 24 from the cavity 56 but allow limited vertical travel.

The adjustment mechanism 32 and threads 44 are engaged by threading the corresponding threads 44 on the threaded portion 42 of the adjustment mechanism 32. The assembled adjustment mechanism 32 is deposited in the adjustment mechanism cavity 34 from the concealed side 58 of the body 22. An additional clearance opening 88 is provided for retaining the nut 46. In this regard, the central axis 54 of the adjustment mechanism 32 may be positioned forwardly towards the face side 52 of the body 22 thereby minimizing the thickness of the body 22. In a similar manner, a vertical opening 90 is provided in the face side 52 which provides additional clearance for the radially extending area 64 of the head 62. These clearances allow the first leaf 24 to be positioned as close to the surface of the first structure or door 28 as possible.

Figure 5:
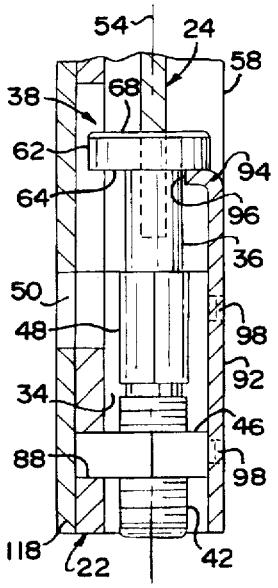
FIG. 5 is a partial fragmentary, cross-sectional, side elevational view taken along line 5—5 in FIG. 3 showing the engagement of the adjustment mechanism with the first leaf and retention of the adjustment mechanism within the body.

With further reference to FIGS. 2 and 5, once the first leaf 24 is inserted into the leaf cavity 56 and the adjustment mechanism 32 and nut 46 are deposited in the adjustment mechanism cavity 34, a retaining panel 92 is positioned over the adjustment mechanism cavity 34 and secured to the concealed side 58 of the body 22. The retaining panel 92 is generally a planer structure but includes an alignment flange 94 which projects there from and extends into the adjustment mechanism cavity 34. An edge 96 of the alignment flange 94 is positioned in close proximity to the shaft 36. The retaining panel 92 retains the adjustment mechanism 32 and nut 46 in the adjustment mechanism cavity 34 by covering the cavity 34 and also helps to maintain axial alignment of the adjustment mechanism 32 along the central axis 54. As shown generally in FIGS. 4 and 5, the alignment flange 94 is attached by means of peened studs 98 or any other convenient method such a using adhesive or screws. It should be noted that the retaining panel may not be necessary if the body 22 is retained in a door assembly which retains the components in the body 22. The retaining panel 92 does facilitate the easy handling of the assembly without concern for disengagement of components from the body 22.

The first and second leafs 24, 26 include a first joint portion 100 and a second joint portion 102, respectively. The joint portions 100, 102 include at least one knuckle 104 extending from each of the planer portions 86, 106 of the first and second leafs 24, 26. The first and second leafs 24, 26 are retained in pivotal engagement by a hinge pin 108 which extends through openings in the knuckles 104.

Figure 6:
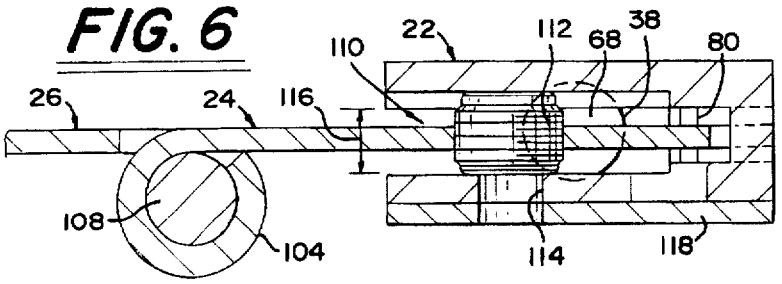
FIG. 6 is a partial fragmentary, cross-sectional, plan view taken along line 6—6 in FIG. 3 showing the position and orientation of a head of the adjustment mechanism and showing the structure of a horizontal adjustment mechanism also provided in the adjustable hinge.

As an additional matter, the present invention also provides a horizontal adjustment. As shown in FIG. 6, a horizontal adjustment set screw 110 is engaged in a threaded hole 112 in the planer portion 86 of the first leaf 24. An elongated axis aperture 114 is formed in the face side 52 of the body 22 to provide access to the horizontal adjustment set screw. The elongated aperture 114 assures that the set screw 110 can be accessed and engaged regardless of the vertical position of the first leaf 24. Rotation of the set screw 110 urges the first leaf 24 to move relative to the body 22 in order to precisely adjust the horizontal position of the hinge 20. As shown in FIG. 6, a cavity dimension 116 of the leg cavity 56 provides space to accommodate horizontal adjustment of the first leaf 24.

When the horizontal adjustment mechanism 110 is provided in the present invention, the head 62 must be provided with extended radial portions 64 in order to engage the slot 40 regardless of the horizontal position of the first leaf 24 in the leaf cavity 56. The radially extending portions 64 engaging the cross extensions 66 will provide for vertical displacement and engagement regardless of the horizontal position of the first leaf 24. As shown in FIG. 6, the head 62 extends beyond the cavity dimension 116 thereby assuring engagement between the adjustment mechanism 32 and the first leaf 24.

Finally, a cover plate 118 provides a cosmetic cover over the face side 52 of the body 22. As shown in FIG. 1, fasteners 120 are driven through the cover plate 118 and are used to secure the body 22 to the door 28. The screws 120 have been omitted in FIG. 2 in the interest of clarity.

Figure 7:
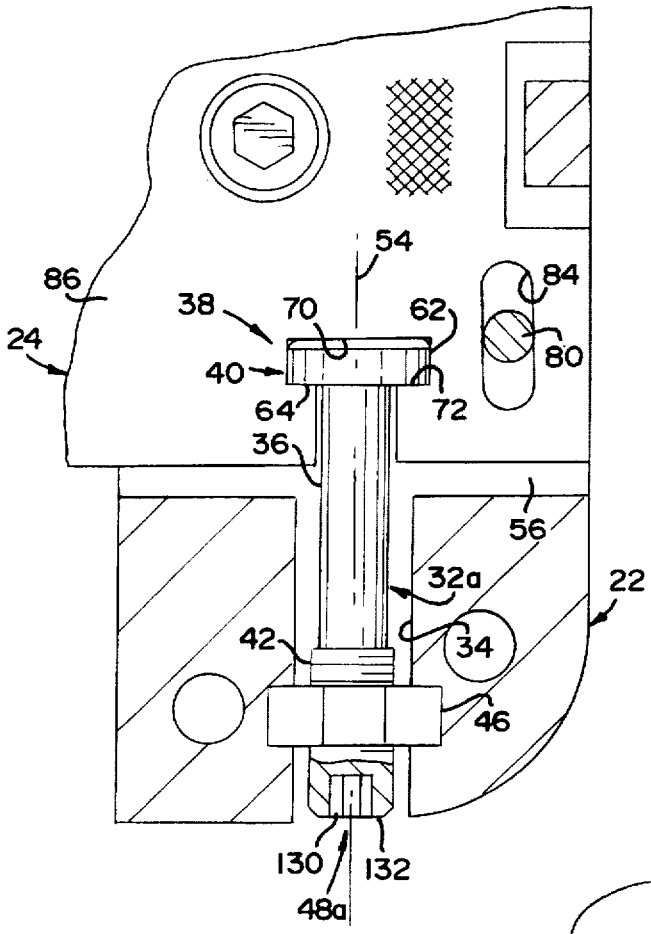
FIG. 7 is an enlarged, partial fragmentary, partial cross-sectional, side elevational view showing the operation of a second embodiment of the adjustment mechanism having a head retained on the first leaf and a fixed thread retained in the body.
Figure 8:
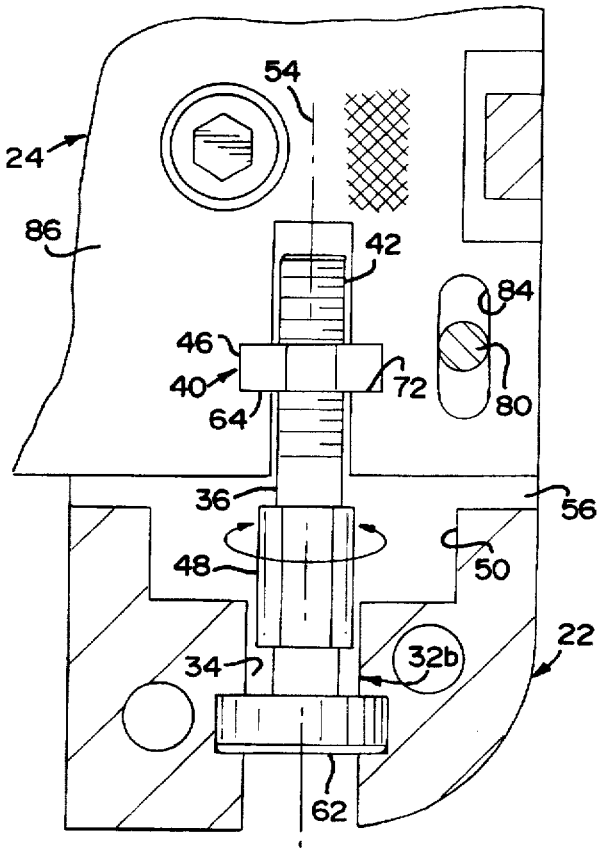
FIG. 8 is an enlarged, cross-sectional, side elevational view similar to that as shown in FIG. 7 showing a third embodiment of the adjustment mechanism in which the head of the adjustment mechanism is retained in the body and the fixed thread is retained relative to the first leaf.

Additional embodiments of the present invention are shown in FIGS. 7 and 8. FIG. 7 shows a second embodiment of the present invention while FIG. 8 shows a third embodiment of the present invention. Structures and functions which are identical to those as set forth in FIGS. 1–6 as described hereinabove are identified with identical reference numerals whereas structures and functions which are similar to those are identified by an alphabetic suffix; for example, the adjustment mechanism in the second embodiment is referred to as adjustment mechanism **32*a* whereas the adjustment mechanism in the third embodiment is referred to as adjustment mechanism 32*b***.

With further reference to FIG. 7, the adjustment mechanism **32*a* is retained within the adjustment mechanism cavity 34. It will be appreciated that the structure and function of the adjustment mechanism 32*a* shown in FIG. 7 is substantially identical to that as shown in FIGS. 1–6 with the exception that the window 50 is not provided in the body 22. In this regard, a drive portion 48*a* has been provided in the form of a recess 130 formed in an end 132 of the adjustment mechanism opposite the first end 38. The adjustment mechanism then allows for adjustment from the bottom side of the body 22**.

The head 62 is retained in the leaf as described hereinabove, and the nut 46 having the fixed thread 44 retained therein is disclosed in the body 22. As also discussed above, the fixed thread 44 could be tapped directly into the adjustment mechanism cavity 34 of the body 22 for engagement with the threaded portion 42 on the shaft 36.

Adjustment of the adjustment mechanism **32*a* is accomplished by preadjusting the adjustment mechanism 32*a* before it is mounted to the first structure or door 28. Alternatively, a small area may be cut out immediately below the body 22 in the door 28 to accommodate insertion of an hex wrench or other angled or directed driving structure for engagement in the recess 130 of the drive portion 48*a*. As shown in FIG. 7, the recess is sized and dimensioned to receive a hex wrench therein. It should be understood that a variety of recesses having a variety of dimensions and shapes can be provided. Additionally, it should be understood that the drive portion 48*a*** may also be an exterior drive engagement portion as opposed to a recess as specifically illustrated herein.

Adjustment of the adjustment mechanism **32*a* in the adjustment mechanism cavity 34 drives the first leaf 24 upwardly and downwardly relative to the body 22. In a similar manner as described hereinabove with regard to the first embodiment; operation of the drive portion 48*a* rotates the shaft 36. Rotation of the shaft results in threaded movement from the threaded portion 42 being engaged with the fixed thread 44. Threaded operation of the adjustment mechanism 32*a* results in displacement along the axis 54**.

Turning now to the third embodiment as shown in FIG. 8, the drive mechanism 32*b* is essentially an inverted form of the drive mechanism 32 as shown in FIGS. 1–6. More specifically, the head 62 is retained in the body 22 and the nut 46 is retained in the first leaf 24. The drive portion 48 is provided on the shaft 36 to permit rotation of the adjustment mechanism 32*b*. The slot in the first leaf is somewhat longer than as shown in FIGS. 2, 3 and 7 in order to accommodate the additional length of the threaded portion and the movement of the threaded portion therethrough upon operation of the adjustment mechanism 32*b*. It should also be understood, as similarly mentioned hereinabove, that the fixed threaded portion 44 need not only be provided in the nut 46 but may, alternatively, be formed in the first leaf 24 to engage the threaded portion 42.

Operation of the adjustment mechanism 32*b* is provided by engaging a wrench, as described hereinabove and shown in FIG. 4, with the drive portion 48. The wrench 53 is inserted into the window 50 to engage the drive portion 48. Thereupon the wrench can then be operated in order to threadedly drive the first leaf 24 as a result of rotating the shaft 36 relative to the fixed thread 44, shown in FIG. 8 as the nut 46.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A vertically adjustable hinge comprising:

a body for attachment to a first structure;

a first leaf adjustably retained in said body and having a first joint portion extending from said body;

a second leaf for attachment to a second structure and having a second joint portion engaged with said first joint portion of said first leaf;

a slot in said first leaf positioned in a portion of said first leaf retained within said body;

a fixed thread retained by one of said body and said slot in said first leaf; and a vertical adjustment mechanism positioned in said body, said adjustment mechanism including a first end retained by the other of said body and said slot in said first leaf and a threaded portion threadedly engaged with said fixed thread, rotation of said adjustment mechanism producing displacement of said first leaf relative to said body.

2. A vertically adjustable hinge as recited in claim 1, wherein:

said fixed thread is retained by said slot in said first leaf;

said vertical adjustment mechanism is oriented with said first end retained in said body; and said threaded portion of said vertical adjustment mechanism is engaged with said fixed thread in said slot in said first leaf.

3. A vertically adjustable hinge as recited in claim 1, wherein:

said fixed thread is retained in said body;

said first end of said vertical adjustment mechanism is retained by said slot in said first leaf; and said threaded portion of said vertical adjustment mechanism is engaged with said fixed thread retained in said body.

4. A vertically adjustable hinge as recited in claim 3, further comprising:

said slot in said first leaf defining a T-shaped slot, said first end of said adjustment mechanism having a head sized and dimensioned for engagement in said T-shaped slot with two opposed cross extensions of said T-shaped slot receiving corresponding radially extending portions of said head.

5. A vertically adjustable hinge as recited in claim 3, said adjustment mechanism further comprising:

an axially elongated shaft having a head on a first end thereof and said threaded portion disposed opposite said head; and a drive portion disposed on said shaft spaced from said head for engagement by a tool.

6. A vertically adjustable hinge as recited in claim 3, wherein said body defines a leaf cavity therein said body also defines an adjustment mechanism cavity in which a portion of said adjustment mechanism and said fixed thread is retained; and said body includes a window extending from a face side of said body and communicating with said adjustment mechanism cavity for providing access to a portion of said adjustment mechanism to facilitate engagement by a tool with said adjustment mechanism when said adjustment mechanism is attached to a first structure to effect vertical movement of said first leaf within said leaf cavity.

7. A vertically adjustable hinge as recited in claim 6, wherein:

said fixed thread comprising a nut having threads, said nut being captively retained in said adjustment mechanism cavity, said threaded portion of said adjustment mechanism engaging said threads in said nut resulting in vertical movement of said adjustment mechanism, and said first leaf engaged therewith, upon rotation of that adjustment mechanism by engagement of a tool with said drive portion.

8. A vertically adjustable hinge as recited in claim 3, further comprising:

a drive portion disposed on said adjustment mechanism between said first end and said threaded portion, said drive portion being engagable by a tool to rotate said adjustment mechanism;

a leaf cavity defined in said body for receiving said first leaf therein, said leaf cavity being sized and dimensioned to permit vertical displacement of said first leaf retained therein;

an adjustment mechanism cavity defined in said body communicating with said leaf cavity, said adjustment mechanism being disposed in said adjustment mechanism cavity and extending into said leaf cavity, said first end of said adjustment mechanism engaging said slot in said first leaf; and an adjustment window communicating with at least said adjustment mechanism cavity, said drive portion being aligned for access thereto through said window to facilitate engagement of a tool with said drive portion to effect rotation of said adjustment mechanism for vertically adjusting said first leaf.

9. A vertically adjustable hinge as recited in claim 3, further comprising:

said body having a face side and a concealed side;

a leaf cavity defined in said body parallely oriented relative to said face side and concealed side;

an adjustment mechanism cavity in said body communicating with said leaf cavity, said adjustment mechanism being disposed in said adjustment mechanism cavity and extending into said leaf cavity for engaging said first end of said adjustment mechanism with said slot in said first leaf;

a window formed in said body extending through said face side and communicating with said adjustment mechanism cavity; and a drive portion of said adjustment mechanism positioned between said threaded portion and said first end, the drive portion being accessible through said window for facilitating engagement of a tool with said drive portion to rotate said adjustment mechanism to produce vertical displacement of said adjustment mechanism and said first leaf engaged therewith.

10. A vertically adjustable hinge as recited in claim 9, said adjustment mechanism cavity extending through said concealed side of said body, said adjustment mechanism being disposed in said adjustment mechanism cavity from said concealed side of said body, a retaining panel positioned, over said adjustment mechanism cavity and attached to said concealed side of said body to retain said adjustment mechanism in said adjustment mechanism cavity.

11. A vertically adjustable hinge as recited in claim 10, said retaining panel further comprising:

an aligning flange extending from said retaining panel inwardly into said adjustment mechanism cavity, an edge of said aligning flange being positioned in close proximity to said adjustment mechanism for promoting axial alignment of said adjustment mechanism along a rotary axis.

12. An adjustable hinge leaf comprising:

a body;

a first leaf adjustably retained in said body;

said first leaf having a slot positioned in a portion of said first leaf retained within said body;

a fixed thread retained in said body;

a vertical adjustment mechanism positioned in said body, said adjustment mechanism including a first end engaged by said slot of said first leaf and a threaded portion engaged with said fixed thread in said body; and a drive portion disposed on said vertical adjustment mechanism between said first end and said threaded portion being accessible through an opening in said body for engagement by a tool.

13. An adjustable hinge leaf comprising:

a body;

a first leaf adjustably retained in said body;

a fixed thread retained by one of said body and said first leaf;

a vertical adjustment mechanism positioned in said body, said adjustment mechanism including a first end retained by the other of said body and said first leaf and a threaded portion engaged with said fixed thread; and a drive portion on said adjustment mechanism for engagement by a tool to rotate said adjustment mechanism producing displacement of said first leaf relative to said body.

14. An adjustable hinge leaf as recited in claim 13, further comprising:

said drive portion being disposed on an end of said adjustment mechanism and being generally coaxial with said adjustment mechanism for engagement with said adjustment mechanism and rotation thereof.

15. A vertically adjustable hinge comprising:

a body;

a leaf cavity defined in said body;

a first leaf having a planer portion positioned in said leaf cavity and a joint portion extending from said leaf cavity;

a second leaf having a second joint portion attached to said joint portion of said first leaf, said first leaf and said second leaf being pivotable relative to one another;

an adjustment mechanism cavity in said body communicating with said leaf cavity;

an axially elongated adjustment mechanism disposed in said adjustment mechanism cavity and extending into said leaf cavity;

a slot in said planer portion of said first leaf, said slot being sized, dimensioned and positioned for engagement with and end of said adjustment mechanism;

a window extending through a face side of said body and communicating with said adjustment mechanism cavity;

a nut retained in said adjustment mechanism cavity; and said adjustment mechanism having a threaded portion threadedly engaged with said nut to provide displacement of said first leaf in said leaf cavity upon rotation of said adjustment mechanism.

16. A vertically adjustable hinge as recited in claim 15, further comprising:

said slot defined in said first leaf defining a T-shaped slot, said first end of said adjustment mechanism having a head sized and dimensioned for engagement in said T-shaped slot with two opposed cross extensions of said T-shaped slot receiving radially extending portions of said head.

17. A vertically adjustable hinge as recited in claim 15, said adjustment mechanism further comprising:

an axially elongated shaft having a head on a first end thereof and said threaded portion disposed opposite said head; and a drive portion disposed on said shaft between said head and said threaded portion for engagement by a tool.

18. A vertically adjustable hinge as recited in claim 15, said body having a face side and a concealed side, said adjustment mechanism cavity extending through said concealed side of said body, said adjustment mechanism being disposed in said adjustment mechanism cavity from said concealed side of said body, a retaining panel positioned over said adjustment mechanism cavity and attached to said concealed side of said body to retain said adjustment mechanism in said adjustment mechanism cavity.

19. A vertically adjustable hinge as recited in claim 18, said retaining panel further comprising:

an aligning flange extending from said retaining panel inwardly into said adjustment mechanism cavity, an edge of said aligning flange being positioned in close proximity to said adjustment mechanism for promoting axial alignment of said adjustment mechanism along a rotary axis.

20. A vertically adjustable hinge as recited in claim 15, further comprising said first leaf and said second leaf being independent structures, said first joint portion of said first leaf defining at least one hinge knuckle and said second joint portion of said second leaf including at least one knuckle, a hinge pin extending through said knuckles on said first leaf and said second leaf to provide a pivoting action.

21. A vertically adjustable hinge leaf comprising:

a body;

a leaf cavity defined in said body;

a leaf having a planer portion positioned in said leaf cavity and a joint portion extending from said leaf cavity;

an adjustment mechanism cavity in said body communicating with said leaf cavity;

an axially elongated adjustment mechanism disposed in said adjustment mechanism cavity and extending into said leaf cavity;

a slot in said planer portion of said leaf, said slot being sized, dimensioned and positioned for engagement with and end of said adjustment mechanism;

a window extending through a face side of said body and communicating with said adjustment mechanism cavity;

a nut retained in said adjustment mechanism cavity; and said adjustment mechanism having a threaded portion threadedly engaged with said nut to provide displacement of said leaf in said leaf cavity upon rotation of said adjustment mechanism.

22. A vertically adjustable hinge as recited in claim 21, further comprising:

said slot defined in said first leaf defining a T-shaped slot, said first end of said adjustment mechanism having a head sized and dimensioned for engagement in said T-shaped slot with two opposed cross extensions of said T-shaped slot receiving radially extending portions of said head.

23. A vertically adjustable hinge as recited in claim 21, said adjustment mechanism further comprising:

an axially elongated shaft having a head on a first end thereof and said threaded portion disposed opposite said head; and a drive portion disposed on said shaft between said head and said threaded portion for engagement by a tool.

24. A vertically adjustable hinge as recited in claim 21, said body having a face side and a concealed side, said adjustment mechanism cavity extending through said concealed side of said body, said adjustment mechanism being disposed in said adjustment mechanism cavity from said concealed side of said body, a retaining panel positioned over said adjustment mechanism cavity and attached to said concealed side of said body to retain said adjustment mechanism in said adjustment mechanism cavity.

25. A vertically adjustable hinge as recited in claim 24, said retaining panel further comprising:

an aligning flange extending from said retaining panel inwardly into said adjustment mechanism cavity, an edge of said aligning flange being positioned in close proximity to said adjustment mechanism for promoting axial alignment of said adjustment mechanism along a rotary axis.

* * * * *

UNITED STATES PATENT AND TRADEMARK OFFICE

CERTIFICATE OF CORRECTION

PATENT NO. : 5,713,105
DATED : February 3, 1998
INVENTOR(S) : Mark H. Toomey

It is certified that error appears in the above-indentified patent and that said Letters Patent is hereby corrected as shown below:

Column 1, Line 12 " an " should be -- art --

Column 1, Line 31 " pans " should be -- parts --

Column 1, Line 33 " an " should be -- art --

Column 3, Line 61 "requiting" should be -- requiring --

Column 10, Line 19 " and end " should be -- an end --

Column 11, Line 13 " and end " should be -- an end --

Signed and Sealed this

Eighteenth Day of August, 1998

Bruce Lehman

*Attest:*

BRUCE LEHMAN

*Attesting Officer*

*Commissioner of Patents and Trademarks*